US011243551B1

(12) United States Patent
Liang et al.

(10) Patent No.: US 11,243,551 B1
(45) Date of Patent: Feb. 8, 2022

(54) METHOD AND SYSTEM OF DYNAMIC VOLTAGE COMPENSATION FOR ELECTRICAL POWER DELIVERY

(71) Applicant: Renesas Electronics America Inc., Milpitas, CA (US)

(72) Inventors: Zhigang Liang, Fremont, CA (US); Qian Sun, Milpitas, CA (US); Bin Li, Apex, NC (US)

(73) Assignee: Renesas Electronics America Inc., Milpitas, CA (US)

( * ) Notice: Subject to any disclaimer, the term of this patent is extended or adjusted under 35 U.S.C. 154(b) by 0 days.

(21) Appl. No.: 17/031,323

(22) Filed: Sep. 24, 2020

(51) Int. Cl.
*G05F 1/46* (2006.01)

(52) U.S. Cl.
CPC ..... *G05F 1/46* (2013.01)

(58) Field of Classification Search
None
See application file for complete search history.

(56) References Cited

U.S. PATENT DOCUMENTS 6,144,187 A * 11/2000 Bryson ..... H02J 7/00712 320/137
6,559,626 B2 * 5/2003 Horie ..... G05F 1/575 323/282
7,880,443 B2 * 2/2011 Solie ..... H02J 7/022 320/160
8,350,536 B2 * 1/2013 Lueger ..... H02J 7/0072 320/164
8,937,497 B1 * 1/2015 Tobin ..... G06F 1/26 327/56
9,564,772 B2 * 2/2017 Qiu ..... H02J 7/02
9,729,080 B2 * 8/2017 Maeda ..... H02J 7/02
2007/0216359 A1 * 9/2007 Arai ..... H02J 7/00711 320/130

* cited by examiner

*Primary Examiner* — Thomas J. Hiltunen
(74) *Attorney, Agent, or Firm* — Foley & Lardner LLP

(57) ABSTRACT

Exemplary implementations include dynamically compensating a system voltage by determining an actual load current based on a sense voltage across a sense resistor and a resistance of the sense resistor, the sense resistor being operatively coupled to a system node, generating a gain current based on the actual load current and a predetermined load current, determining a gain voltage based on a system gain and the gain current, and generating a compensation voltage based on a predetermined system voltage at a system node, an actual system voltage at the system node, and the gain voltage. Exemplary implementations also include calibrating a dynamic voltage compensation device by applying a predetermined voltage to a system node operatively coupled to the system load, a sense resistor, and an internal system node, determining a test current based on a sense voltage across the sense resistor and a resistance of the sense resistor, determining a system resistance based on the predetermined voltage, the test current, and an internal system voltage at the internal system node, and setting a system gain based on the system resistance at a gain block device.

20 Claims, 7 Drawing Sheets

400

METHOD AND SYSTEM OF DYNAMIC VOLTAGE COMPENSATION FOR ELECTRICAL POWER DELIVERY

TECHNICAL FIELD

The present embodiments relate generally to electrical power systems and devices, and more particularly to dynamic voltage compensation for electrical power delivery.

BACKGROUND

Electronic devices are increasingly ubiquitous in many individual and interpersonal activities. In addition, electronic devices are increasing exposed to dynamically varying power requirements from numerous integrated and separable devices and systems. Accordingly, it is increasingly desirable to provide flexibility in power system architecture for electronic devices to accommodate the numerous integrated and separable devices and systems that may require electric power from such electronic devices. Conventional system, however, do not effectively accommodate dynamically varying power or dynamically compensating voltage associated with power systems having flexibility in power system architecture. Thus, there exists a need to provide dynamic voltage compensation for electrical power delivery.

SUMMARY

Exemplary implementations include dynamically compensating a system voltage by determining an actual load current based on a sense voltage across a sense resistor and a resistance of the sense resistor, the sense resistor being operatively coupled to a system node, generating a gain current based on the actual load current and a predetermined load current, determining a gain voltage based on a system gain and the gain current, and generating a compensation voltage based on a predetermined system voltage at a system node, an actual system voltage at the system node, and the gain voltage.

Exemplary implementations also include calibrating a dynamic voltage compensation device by applying a predetermined voltage to a system node operatively coupled to the system load, a sense resistor, and an internal system node, determining a test current based on a sense voltage across the sense resistor and a resistance of the sense resistor, determining a system resistance based on the predetermined voltage, the test current, and an internal system voltage at the internal system node, and setting a system gain based on the system resistance at a gain block device.

Exemplary implementations also include a dynamic voltage compensator device with a first input conditioning device operably coupled to a sense resistor, and operable to determine an actual load current based on a sense voltage across the sense resistor and a resistance of the sense resistor, a gain block device operatively coupled to the first signal conditioning device and operable to determine a gain voltage based on a system gain and a gain current, and a third input conditioning device operatively coupled to the gain block device and a system node operatively coupled to the sense resistor, and operable to generate a compensation voltage based on the predetermined system voltage at the system node, an actual system voltage at the system node, and the gain voltage.

BRIEF DESCRIPTION OF THE DRAWINGS

These and other aspects and features of the present embodiments will become apparent to those ordinarily skilled in the art upon review of the following description of specific embodiments in conjunction with the accompanying figures, wherein.

DETAILED DESCRIPTION

The present embodiments will now be described in detail with reference to the drawings, which are provided as illustrative examples of the embodiments so as to enable those skilled in the art to practice the embodiments and alternatives apparent to those skilled in the art. Notably, the figures and examples below are not meant to limit the scope of the present embodiments to a single embodiment, but other embodiments are possible by way of interchange of some or all of the described or illustrated elements. Moreover, where certain elements of the present embodiments can be partially or fully implemented using known components, only those portions of such known components that are necessary for an understanding of the present embodiments will be described, and detailed descriptions of other portions of such known components will be omitted so as not to obscure the present embodiments. Embodiments described as being implemented in software should not be limited thereto, but can include embodiments implemented in hardware, or combinations of software and hardware, and vice-versa, as will be apparent to those skilled in the art, unless otherwise specified herein. In the present specification, an embodiment showing a singular component should not be considered limiting; rather, the present disclosure is intended to encompass other embodiments including a plurality of the same component, and vice-versa, unless explicitly stated otherwise herein. Moreover, applicants do not intend for any term in the specification or claims to be ascribed an uncommon or special meaning unless explicitly set forth as such. Further, the present embodiments encompass present and future known equivalents to the known components referred to herein by way of illustration.

Figure 1:
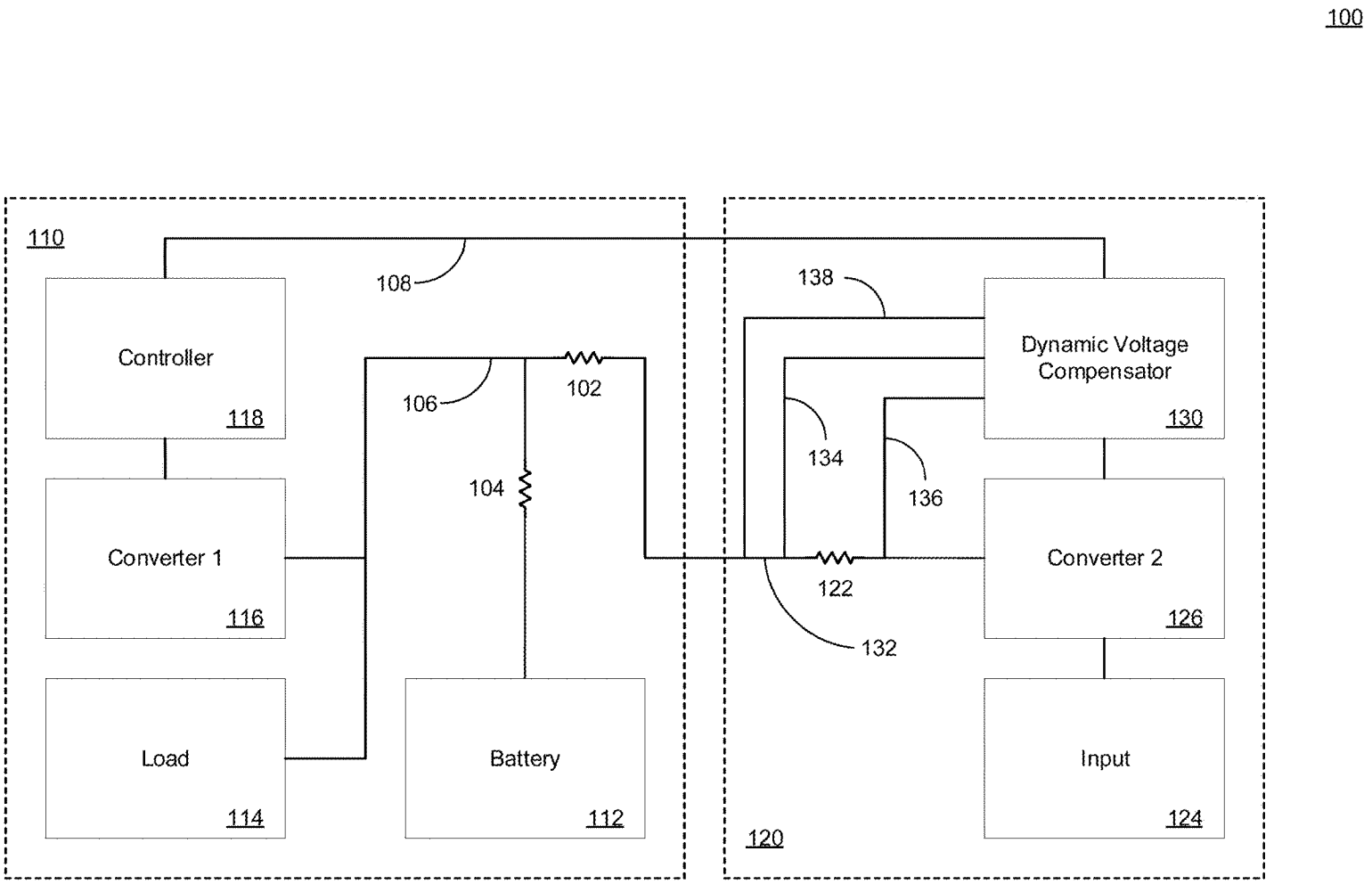
FIG. 1 illustrates an exemplary system in accordance with present implementations.

FIG. 1 illustrates an exemplary system in accordance with present implementations. As illustrated by way of example in FIG. 1, an exemplary system 100 in accordance with present implementations includes a battery region 110 and a compensator region 120. In some implementations, the battery region 110 and the compensator region 120 are each distinct electronic components, circuit boards, electronic packages, or the like. In some implementations, the battery region 110 is a circuit board including a one or more devices associated, integrable, or integrated with an electronic user system. In some implementations, an electronic user system includes at least one of an electronic display, electronic computer, or the like. In some implementations, that compensator region 120 includes one or more devices extending, supplementing, complementing, modifying, or the like, operation of the battery region 110. In some implementations, the compensator region 120 is operable to provide power from a power converter or input distinct from a power converter or input associated with, integrated with, integrable with, or the like, with the battery region 110.

In some implementations, the battery region 110 includes a system resistor 102, a battery resistor 104, an internal system node 106, a controller bus 108, a battery 112, a load 114, a first converter 116, and a controller 118. In some implementations, the compensator region 120 includes a sense resistor 122, a system node 132, a first system sense line 134, a second system sense line 136, a system voltage sense line 138, an input 124, a second converter 126, and a dynamic voltage compensator 130.

The system node 132 is operable to transfer one or more electrical signals between the battery region 110 and the compensator region 120. In some implementations, the system node 132 is an interface, coupling, solder point, header, or the like operable to couple the battery region to the compensator region 120. In some implementations, the battery region receives at least one of a voltage, current, and the like from the compensator region 120. Thus, in some implementations, the compensator region 120 provides power to the battery region 110 in addition to that generated, converted, or the like by the battery region 110.

The input 124 includes a source of electrical power, voltage, current, or the like for supplying power to the system 100. In some implementations, the input 124 includes, but is not limited to regulated 120 V AC power, regulated 220V AC power, 5V DC power, 12V DC power, or the like. In some implementations, the input 124 includes a wired power connection, a wireless direct contact power connection, a wireless and contactless power connection, the like, or any power connection as is known or may become known. In some implementations, the input 124 includes one or more USB terminals or ports (e.g., USB-C, USB-PD).

The load 114 includes one or more electrical, electronic, electromechanical, electrochemical, or like devices or systems for receiving power, voltage, current, or the like from one or more of the first converter 116, the second converter 126, and the battery 112 to perform one or more actions. In some implementations, the load 114 includes at least one battery, electronic display, electronic computer, electronic input device, electromechanical input device, electronic output device, electromechanical output device or the like. Examples of these devices include notebook computers, desktop computers, tablets, smartphones, printers, scanners, telephony endpoints, videoconferencing endpoints, keyboards, mice, trackpads, gaming peripherals, monitors, televisions, and the like. In some implementations, the load 114 includes one or more devices partially or fully separable from the system 100. In some implementations, the load 114 includes one or more devices partially or fully integrated or integrable into, or separable from, the system 100.

The battery 112 includes one or more electrical, electronic, electromechanical, electrochemical, or like devices or systems for at least one of receiving, storing and distributing input power. In some implementations, the battery 112 includes one or more stacks of batteries. In some implementations, the battery 112 includes lithium-ion or like energy storage. In some implementations, the battery 112 is integrated with, integrable with, or separable from the system 100. In some implementations, the battery 112 includes a plurality of battery units variously or entirely integrated with, integrable with, or separable from the system 100.

The first converter 116 and the second converter 126 include one or more one or more electrical, electronic, electromechanical, electrochemical, or like devices or systems for charging or discharging the load 114. In some implementations, at least one of the first and second converters 116 and 126 includes a DC-DC power converter. In some implementations, at least one of the first and second converters 116 and 126 includes an inductive charger. An inductive charger may be, but is not limited to, a buck charger, a boost charger, a buck-boost charger, a combination thereof, or the like.

The controller 118 includes one or more electrical, electronic, logical, or like devices for supplying power, voltage, current, or the like to one or more of the first converter 116, the second converter 126, and the battery 112. In some implementations, the controller 118 includes an electronic controller (EC) controlling overall operation of the system 100. The controller bus 108 is operable to communicate one or more instructions, signals, conditions, states, or the like between the battery region 110 and the compensator region 120. In some implementations, the controller bus 108 includes one or more digital, analog, or like communication channels, lines, traces, or the like. In some implementations, the controller bus 108 operatively couples the controller 118 to the dynamic voltage compensator 130, and provides one or more signals representing one or more states of one or more devices associated with the battery region 110. In some implementations, the controller bus 108 provides one or more signals representing one or more states of one or more inputs, outputs, terminals, connections, or the like, of devices associated with the battery region 110.

The internal system node 106 is operable to transfer one or more electrical signals between any combination of the battery 112, the load 114, the first converter 116, and the system node 132. In some implementations, the internal system node 106 is operably coupled to the system node 132 by the system resistor 112. In some implementations, the system resistor 102 is a single resistor coupling the internal system node 106 to the system node 132. Alternatively, in some implementations, the system resistor 102 represents an equivalent resistance of one or more circuit elements disposed between the internal system node 106 and the system node 132. In some implementations, the internal system node 106 is operably coupled to the battery 112 by the battery resistor 104. In some implementations, the battery resistor 104 is a single resistor coupling the internal system node 106 to the battery 112. Alternatively, in some implementations, the battery resistor represents an equivalent resistance of one or more circuit elements disposed between the internal system node 106 and the battery 112.

The sense resistor 112 provides at least one voltage, current, or like characteristic, state, or the like associated with one or more of the system node 132 and one or more component associated with the battery region 110. In some implementations, the sense resistor 112 is operatively coupled to the dynamic voltage compensator by the first system sense line 134 and the second system sense line 136 at opposite ends thereof. The first system sense line 134 and the second system sense line 136 are operable to detect one or more voltage, current, or like characteristic, state, or the like associated with the sense resistor 112. In some implementations, the sense resistor is operable to transmit power between the second converter 126 and the system node 132. In some implementations, the sense resistor 122 generates a voltage drop associated with a current through one or more of the system node 132 and the system resistor 102 from the second converter 126.

The dynamic voltage compensator 130 is operable to at least generate and apply a compensating voltage to the system node 132. In some implementations, the dynamic voltage compensator 130 is operably coupled to the controller 118, the sense resistor 122, the second converter 126, and the system node 132. In some implementations, the dynamic voltage compensator 130 includes one or more electrical, electronic, logical, or like devices for supplying power, voltage, current, or the like to one or more of the system node 132 and the second converter 126. In some implementations, the dynamic voltage compensator 130 receives one or more digital or analog control signals from the controller 118 by the controller bus 108. In some implementations, the dynamic voltage compensator transmits one or more digital or analog control signals to the second converter 126. In some implementations, the dynamic voltage compensator transmits a pulse-width-modulation (PWM) signal to one or more controllers or drivers associated, integrable, or integrated with the second converter 126.

Figure 2:
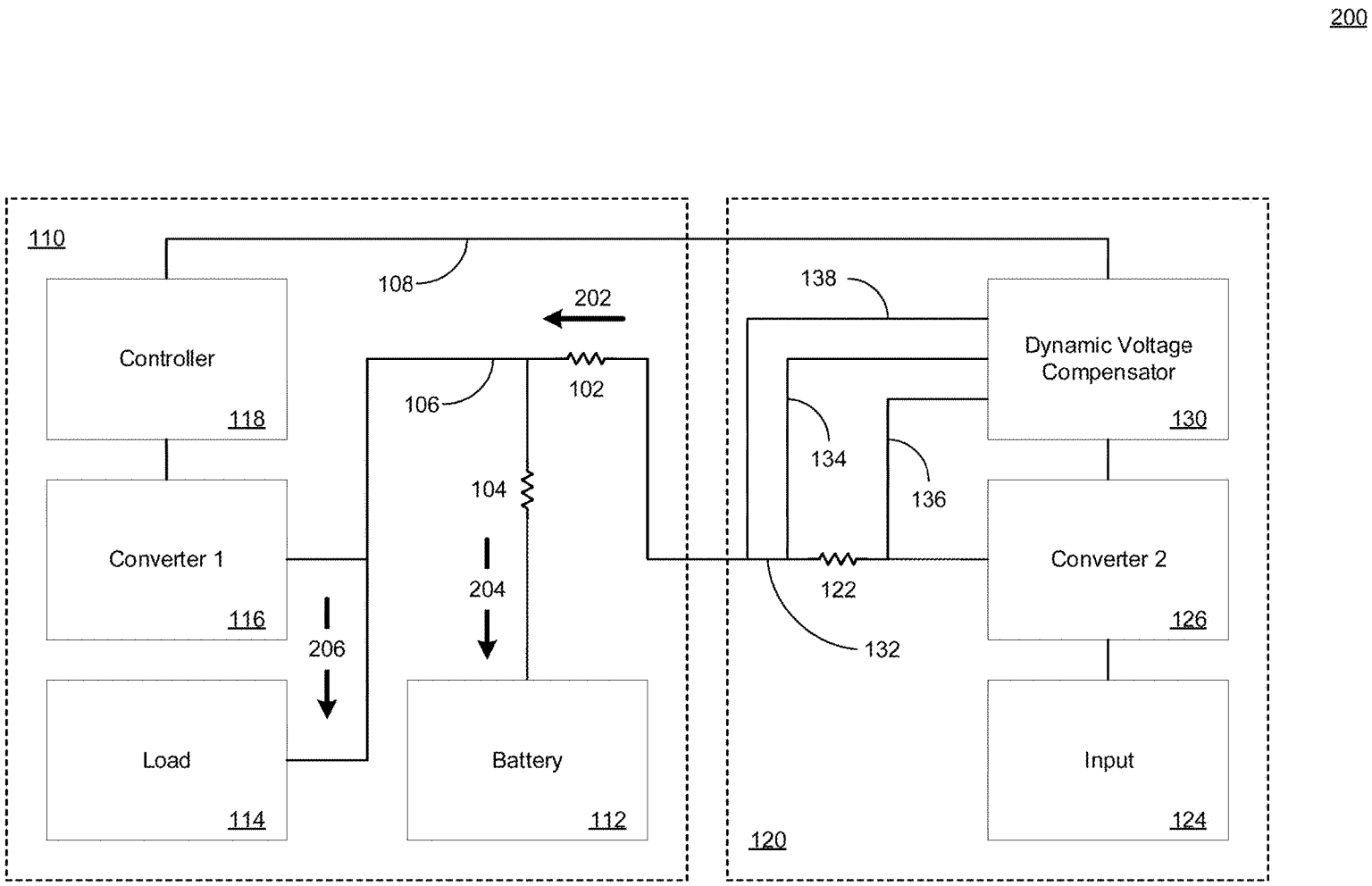
FIG. 2 illustrates the exemplary system of FIG. 1 operating in an exemplary dynamic voltage compensation operation mode.

FIG. 2 illustrates the exemplary system of FIG. 1 operating in an exemplary dynamic voltage compensation operation mode. As illustrated by way of example in FIG. 2, an exemplary system 200 includes a system current 202, a battery current 204, and a load current 206. In some implementations, the system current 202 passes through at least one of the system resistor 102, the sense resistor 122, and the system node 132 in an operating mode. In some implementations, the system current 202 divides into the battery current 204 and the load current 206 at the internal system node 106 in an operating mode. In some implementations, the battery current 204 passes to the battery 112 through the battery resistor 104. It is to be understood that each of the system current 202, the battery current 204, and the load current 206 can flow during an operation mode in accordance with present implementations in directions other than those illustrated herein. It is to be further understood that current can flow to only one of or neither of the battery 112 and the load 114 in an operating mode in accordance with present implementations.

Figure 3:
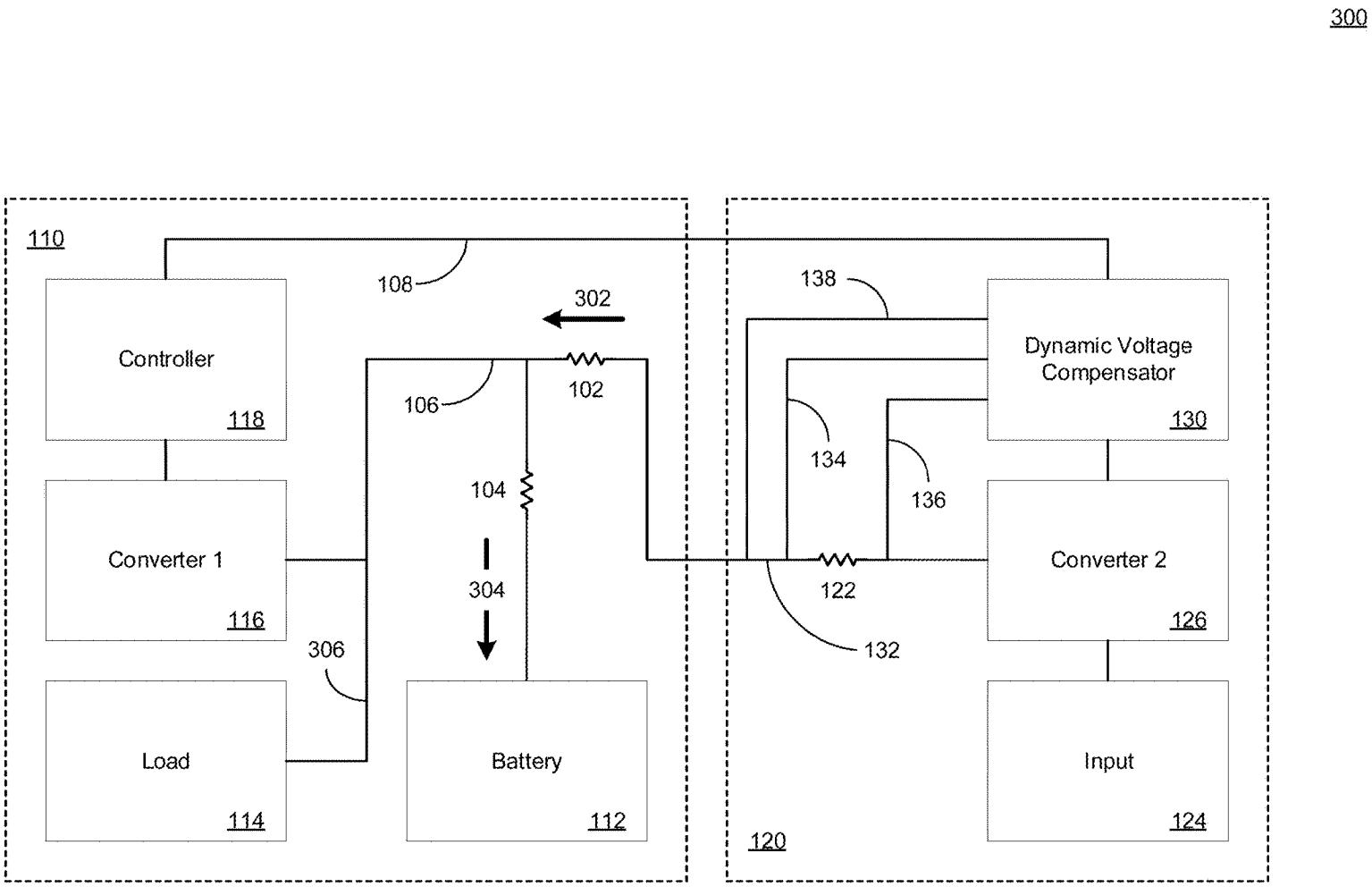
FIG. 3 illustrates the exemplary system of FIG. 1 operating in an exemplary dynamic voltage compensation learning mode.

FIG. 3 illustrates the exemplary system of FIG. 1 operating in an exemplary dynamic voltage compensation learning mode. As illustrated by way of example in FIG. 3, an exemplary system 300 includes a system current 302, a battery current 304, and a load node 306. In some implementations, the system current 302 passes through at least one of the system resistor 102, the sense resistor 122, and the system node 132 in a learning mode. In some implementations, the system current 302 travels undivided to the internal system node 106 and to the battery 112 as the battery current 304 in a learning mode. In some implementations, one or more of the first converter 116, the controller 118 electrically isolates the load 114 from the internal system node 106 in a learning mode. In some implementations, one or more of the first converter 116, the controller 118 electrically isolates the load 114 from the internal system node 106 at the load node 306 in a learning mode. In some implementations, the battery current 304 passes to the battery 112 through the battery resistor 104. It is to be understood that each of the system current 302 and the battery current 304 can flow during a learning mode in accordance with present implementations in directions other than those illustrated herein.

Figure 4:
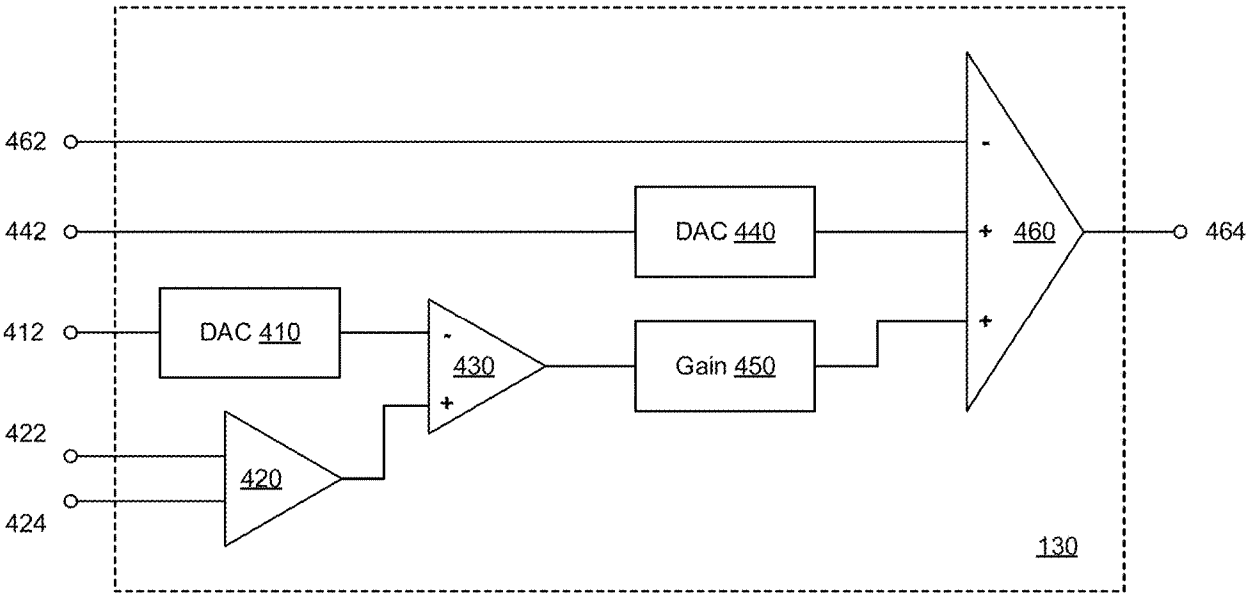
FIG. 4 illustrates an exemplary dynamic voltage compensator device in accordance with present implementations.

FIG. 4 illustrates an exemplary dynamic voltage compensator device in accordance with present implementations. As illustrated by way of example in FIG. 4, the exemplary dynamic voltage compensator 130 includes an ideal current digital-to-analog converter (DAC) 410, a sense current generator 420, a gain current generator 430, an ideal voltage DAC 440, a gain block 450, and a compensation voltage generator 460. In some implementations, the exemplary dynamic voltage compensator 130 is operatively coupled to the controller 118 at an ideal voltage input node 442 and an ideal current input node 412. In some implementations, the controller bus 118 is operatively coupled to the exemplary dynamic voltage compensator 130 at the ideal voltage input node 442 and the ideal current input node 412 through one or more controller bus connections, lines, or the like thereof. In some implementations, the exemplary dynamic voltage compensator 130 is operatively coupled to the system node 132 at an actual voltage input node 462. In some implementations, the exemplary dynamic voltage compensator 130 is operatively coupled to the first system sense line 134 at a first sense current input node 422, and to the second system sense line 136 at a second sense current input node 424. In some implementations, the exemplary dynamic voltage compensator 130 is operatively coupled to the second converter 126 at a dynamic voltage compensation output node 464. In some implementations, one or more of the ideal current DAC 410, the sense current generator 420, the gain current generator 430, the ideal voltage DAC 440, the gain block 450, and the compensation voltage generator 460 include one or more electrical, electronic or like devices and components operable to convert a digital signal to an analog signal. In some implementations, electrical, electronic, or like devices include, but are not limited to, operational amplifiers, integrated circuits, inductors, capacitors, flip-flops, and the like.

The ideal current DAC 410 and the ideal voltage DAC 440 are operable to convert one or more digital signals to one or more analog signals. In some implementations, the ideal current DAC 410 receives a digital ideal current signal $I_{IDEAL}$ from the controller 118 by the controller bus 108, and generates an analog ideal current signal $I_{IDEAL}$. In some implementations, the ideal voltage DAC 440 receives a digital ideal voltage signal $V_{IDEAL}$ from the controller 118 by the controller bus 108, and generates an analog ideal voltage signal $V_{IDEAL}$.

The sense current generator 420 is operable to receive one or more sense voltages and generate a sense current signal based at least in part on the one or more sense voltages. In some implementations, the sense current generator 420 receives a first sense voltage from the first system sense line 134 and a second sense voltage from the second system sense line 136. In some implementations, the sense current generator generates an actual load current $I_{LOAD}$ detected at the sense current generator based on the first sense voltage and the second sense voltage. In some implementations, the first sense voltage is a high-side voltage $V_H$ of the sense resistor 122 and the second sense voltage is a low-side voltage $V_L$ of the sense resistor 122. Alternatively, in some implementations, the first sense voltage is a high-side voltage $V_L$ of the sense resistor 122 and the second sense voltage is a low-side voltage $V_H$ of the sense resistor 122.

The gain current generator 430 is operable to receive the actual load current $I_{LOAD}$ and the ideal current signal $I_{IDEAL}$, and to output a gain current $I_K$ based on a current error. In some implementations, the current error is a difference between the actual load current LOAD and the ideal current signal $I_{IDEAL}$. It is to be understood that in some implementations, the gain current generator 430 receives an analog ideal current signal $I_{IDEAL}$ from the controller 118 by the controller bus 108, and the dynamic voltage compensator 130 does not include the ideal current DAC 410. The gain block 450 is operable to receive the gain current $I_K$ and to generate a gain voltage $V_K$ based on the gain current $I_K$ and a predetermined gain K. In some implementations, the gain K is a scalar value. In some implementations, the gain K is a constant scalar value. In some implementations, the gain block 450 includes a storage portion operable to store the gain K and to perform one or more mathematical operations including the gain K. In some implementations, the storage portion includes one or more electrical or electronic devices. In some implementations, the electrical or electronic devices include, but are not limited to, flip-flops, logical gates, logical gate arrays, and the like.

The compensation voltage generator 460 is operable to receive an actual system voltage $V_{SYS}$, the ideal voltage signal $V_{IDEAL}$, and the gain voltage $V_K$, and to generate a compensation voltage $V_{COMP}$. In some implementations, the compensation voltage generation 460 is an operational amplifier including a first positive input terminal receiving the gain voltage $V_K$, a second positive input terminal receiving the ideal voltage signal $V_{IDEAL}$, and a negative input terminal receiving the actual system voltage $V_{SYS}$. In some implementations, the compensation voltage generator 460 generates the compensation voltage $V_{COMP}$ by arithmetically subtracting the actual system voltage $V_{SYS}$ from a sum of the gain voltage $V_K$ and the ideal voltage signal $V_{IDEAL}$.

Figure 5:
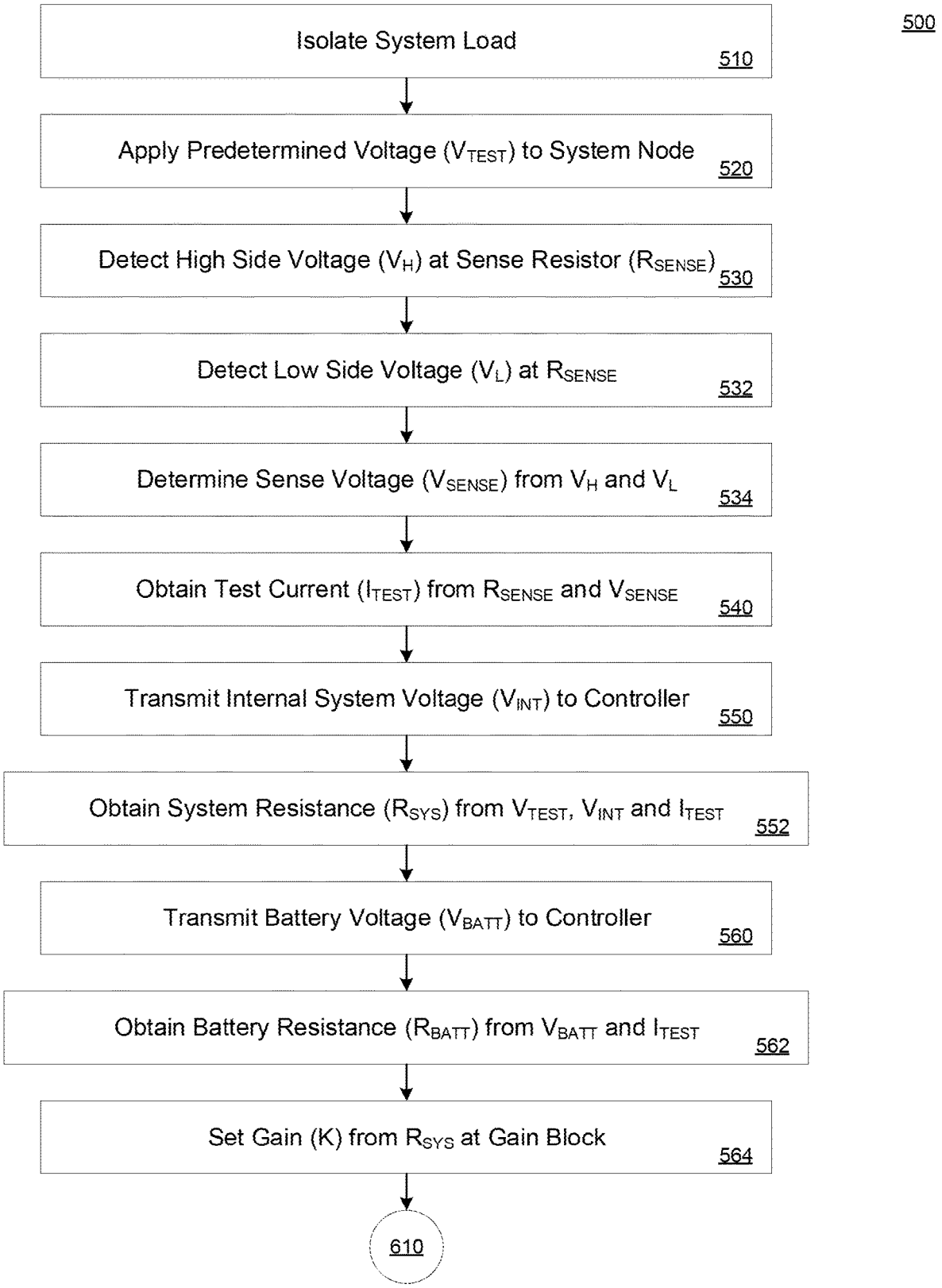
FIG. 5 illustrates an exemplary dynamic voltage compensation learning method in accordance with the exemplary system of FIG. 3.

FIG. 5 illustrates an exemplary dynamic voltage compensation learning method in accordance with the exemplary system of FIG. 3. In some implementations, at least one of the exemplary systems 100 and 300, and the exemplary device 400 performs method 500 according to present implementations. In some implementations, the method 500 begins at step 510.

At step 510, an exemplary system isolates the system load 114. In some implementations, the exemplary system electrically isolates the load 114 in order to minimize division of the system current 302, and to maximize the amount of the system current that flows through the battery resistor 104 as the battery current 304. In some implementations, the system current 302 and the battery current 304 are equal or substantially equal to each other. Thus, the exemplary system 300 can cause a constant current to travel through both of the system resistor 102 and the battery resistor 104. The method 500 then continues to step 520. At step 520, the exemplary system applies a predetermined test voltage $V_{TEST}$ to the system node 132. In some implementations, the dynamic voltage compensator 130 instructs the second converter 126 to apply the predetermined test voltage $V_{TEST}$ to the system node 132. The method 500 then continues to step 530.

At step 530, the exemplary system detects a high-side voltage $V_H$ at the sense resistor 122. In some implementations, the dynamic voltage compensator 130 detects the high-side voltage $V_H$ at the sense resistor 122 through the sense resistor line 136. Alternatively, in some implementations, the dynamic voltage compensator 130 detects a low-side voltage $V_L$ at the sense resistor 122 through the sense resistor line 136. The method 500 then continues to step 532. At step 532, the exemplary system detects a low-side voltage $V_L$ at the sense resistor 122. In some implementations, the dynamic voltage compensator 130 detects the low-side voltage $V_L$ at the sense resistor 122 through the sense resistor line 134. Alternatively, in some implementations, the dynamic voltage compensator 130 detects a high-side voltage $V_H$ at the sense resistor 122 through the sense resistor line 134. The method 500 then continues to step 534. At step 534, the exemplary system determines a sense voltage $V_{SENSE}$ based on the detected high-side voltage $V_H$ and detected low-side voltage $V_L$. In some implementations, the dynamic voltage compensator 130 determines the sense voltage based on a different between the detected high-side voltage $V_H$ and the detected low-side voltage $V_L$. The method 500 then continues to step 540.

At step 540, the exemplary system obtains a test current $I_{TEST}$ based on a resistance of the sense resistor 122 and $V_{SENSE}$. In some implementations, the controller 118 determines $I_{TEST}$ by one or more digital or analog device or components therein or associated therewith. The method 500 then continues to step 550. At step 550, the exemplary system transmits an internal system voltage $V_{INT}$ to the controller 118. In some implementations, the controller 118 receives $V_{INT}$ by one or more digital or analog device or components therein or associated therewith. The method 500 then continues to step 552. At step 552, the exemplary system determines a system resistance $R_{SYS}$ of the system resistor 102 based on $V_{TEST}$, $V_{INT}$ and $I_{TEST}$. The method 500 then continues to step 560. At step 560, the exemplary system transmits a battery voltage $V_{BATT}$ of the battery 112 to the controller 118. At step 562, the exemplary system obtains a battery resistance $R_{BATT}$ of the battery resistor 104 based on $V_{BATT}$ and $I_{TEST}$. The method then continues to step 564. At step 564, the exemplary system sets a gain K based on $R_{SYS}$. In some implementations, the controller 118 sets K equal to or substantially equal to $R_{SYS}$ and transmits one or more control signals by the controller bus 108 to the gain block 450 to set the gain K. It is to be understood that the gain block 450 a can include additional control lines and communication lines to communicate or set the gain K. In some implementations, the method 500 then continues to step 610.

In some implementations, the controller 118 determines at least one of $R_{SYS}$ and $V_{BATT}$ by one or more digital or analog device or components therein or associated therewith. The method 500 then continues to step 562. In some implementations, the first converter 116 applies at least one of $I_{TEST}$ and $V_{INT}$ to the internal system node 106 and transmits at least one of $I_{TEST}$ and $V_{INT}$ to the controller 118. In some implementations, the first converter 116 transmits at least one of $I_{TEST}$ and $V_{INT}$ to the controller 118 by one or more communication lines distinct from the controller bus 108. Alternatively, in some implementations, the first converter 116 transmits at least one of $I_{TEST}$ and $V_{INT}$ to the controller 118 by one or more communication lines associated with the controller bus 108.

Figure 6:
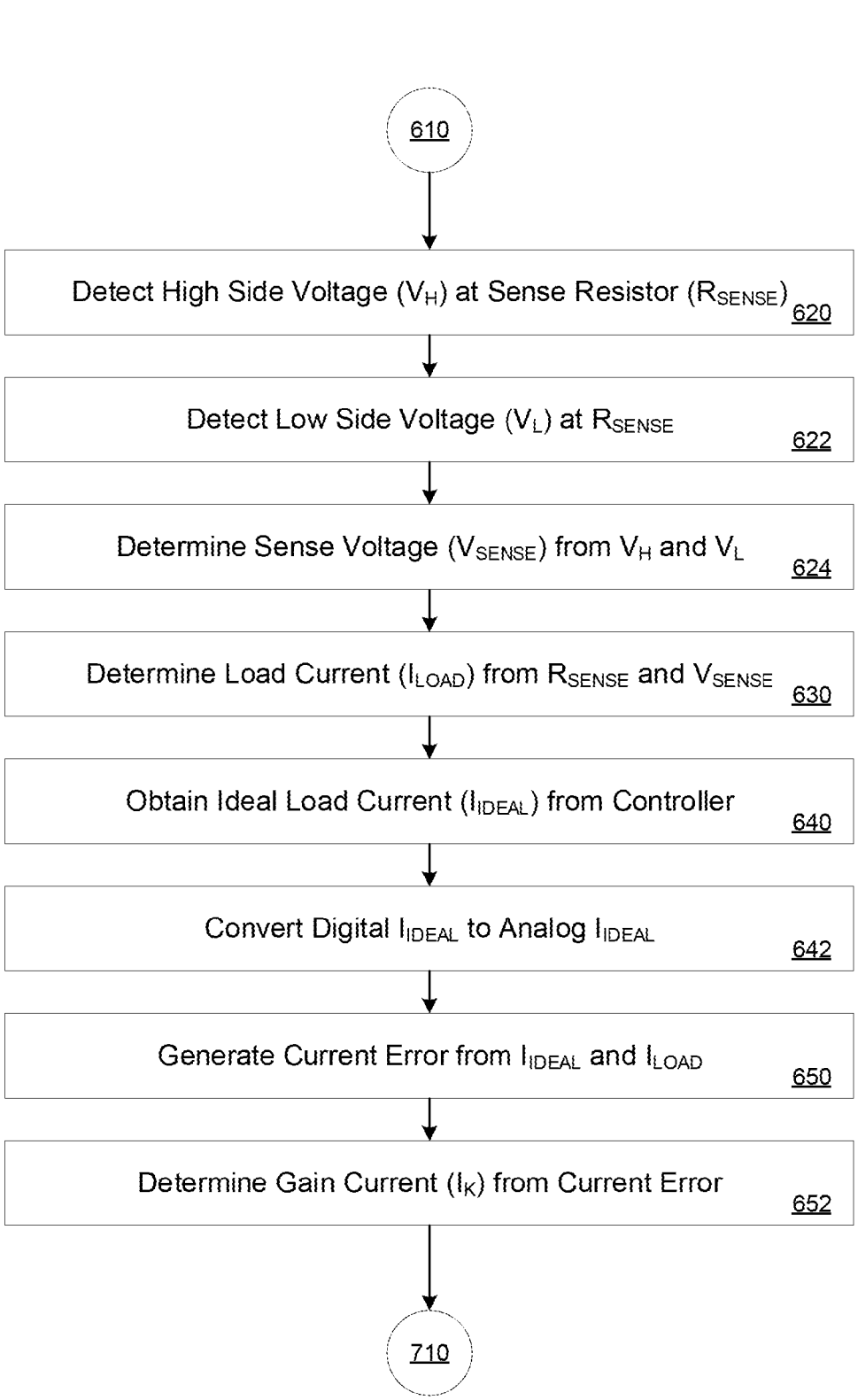
FIG. 6 illustrates an exemplary dynamic voltage compensation operation mode in accordance with the exemplary system of FIG. 2.

FIG. 6 illustrates an exemplary dynamic voltage compensation operation mode in accordance with the exemplary system of FIG. 2. In some implementations, at least one of the exemplary systems 100 and 200, and the exemplary device 400 performs method 600 according to present implementations. At step 610, the method 600 begins. The method 600 then continues to step 620.

At step 620, the exemplary system detects a high-side voltage $V_H$ at the sense resistor 122. In some implementations, the exemplary system detects the high-side voltage $V_H$ in accordance with at least one of the method 500 and the step 530 thereof. The method 600 then continues to step 622. At step 622, the exemplary system detects a low-side voltage $V_L$ at the sense resistor 122. In some implementations, the exemplary system detects the low-side voltage $V_L$ in accordance with at least one of the method 500 and the step 532 thereof. The method 600 then continues to step 624. At step 624, the exemplary system determines a sense voltage $V_{SENSE}$ based on $V_H$ and $V_L$. In some implementations, the exemplary system determines a sense voltage $V_{SENSE}$ in accordance with at least one of the method 500 and the step 534 thereof. The method 600 then continues to step 630.

At step 630, the exemplary system determines a load current LOAD based on a resistance of the sense resistor 122 and $V_{SENSE}$. In some implementations, the dynamic voltage compensator 130 determines the load current by dividing a difference between $V_H$ and $V_L$ by the gain K stored by the gain block 450. In some implementations, the gain K corresponds to the system resistance $R_{SYS}$ of the system resistor 102. The method 600 then continues to step 640. At step 640, the exemplary system obtains an ideal load current $I_{IDEAL}$ from the controller 118. In some implementations, the exemplary system obtains $I_{IDEAL}$ from the controller 118 through the controller bus 108 at the ideal current DAC 410 or the gain current generator 430 of the dynamic voltage compensator 130. In some implementations, the exemplary system obtains a digital $I_{IDEAL}$ from the controller 118. It is to be understood that the controller 118 can provide an analog $I_{IDEAL}$ directly to the dynamic voltage compensator 130 and any component thereof or associated therewith. The method 600 then continues to step 642. Alternatively, in some implementations, the method 600 continues to step 650 where the exemplary system receives obtains an analog IDEAL at the dynamic voltage compensator 130. At step 642, the exemplary system converts the obtained $I_{IDEAL}$ to an analog $I_{IDEAL}$. In some implementations, the exemplary system coverts IDEAL by the ideal current DAC 410. The method 600 then continues to step 650.

At step 650, the exemplary system generates a current error based on $I_{IDEAL}$ and $I_{LOAD}$. In some implementations, the exemplary system generates the current error at least in part by receiving $I_{IDEAL}$ and $I_{LOAD}$ respectively at negative and positive terminals of the gain current generator 430, where the gain current generator 430 is an operational amplifier. The method 600 then continues to step 652. At step 652, the exemplary system determines a gain current $I_K$ based on the current error. In some implementations, the exemplary system generates $I_K$ at least in part by generating, at the gain current generator 430, a difference between $I_{IDEAL}$ and $I_{LOAD}$ and outputting the difference at an output of the gain current generator 430. In some implementations, the method 600 then continues to step 710.

Figure 7:
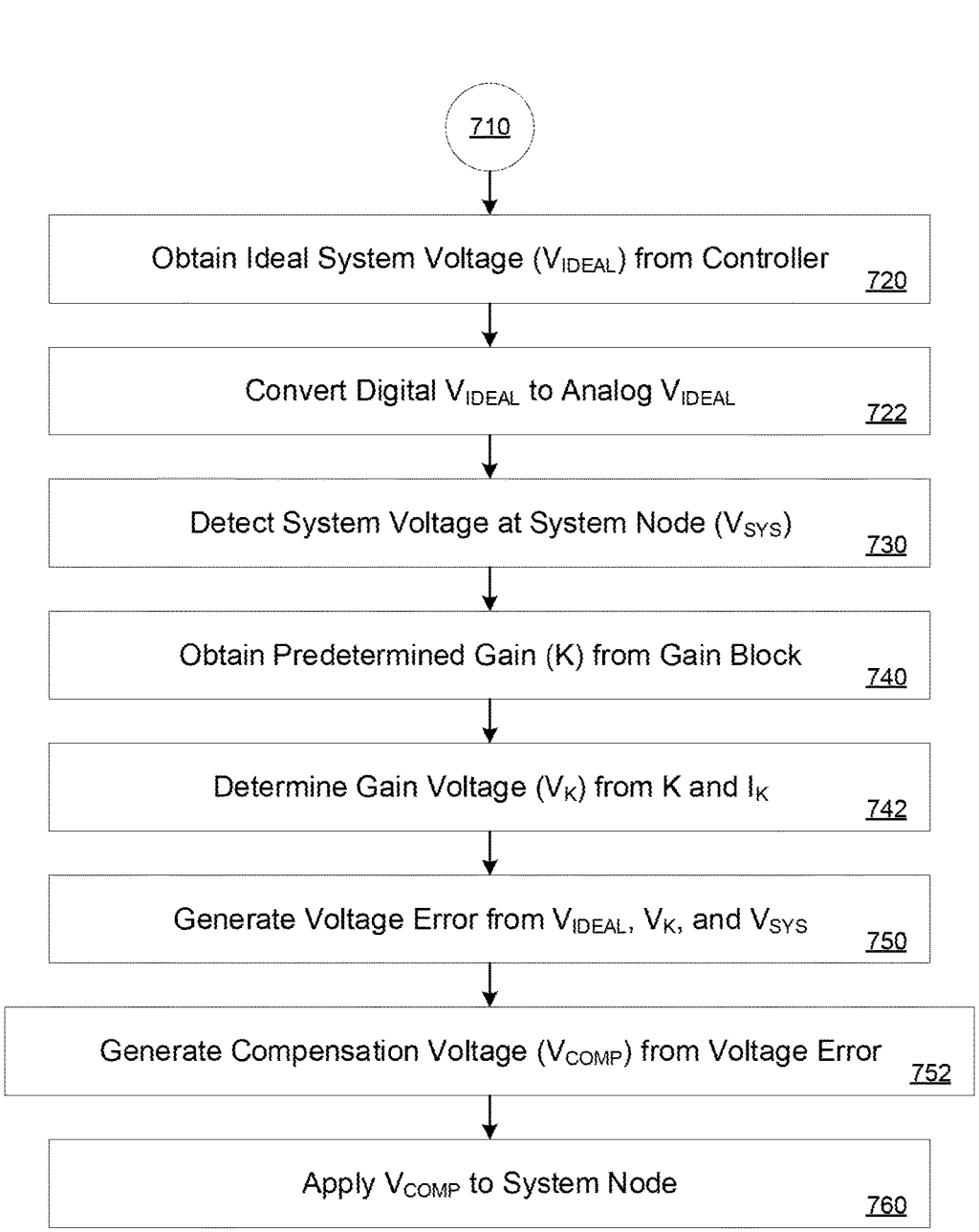
FIG. 7 illustrates an exemplary dynamic voltage compensation operation mode further to the exemplary method of FIG. 6.

FIG. 7 illustrates an exemplary dynamic voltage compensation operation mode further to the exemplary method of FIG. 6. In some implementations, at least one of the exemplary systems 100 and 200, and the exemplary device 400 performs method 700 according to present implementations. At step 710, the method 700 begins. The method 700 then continues to step 720.

At step 720, the exemplary system obtains an ideal system voltage $V_{IDEAL}$ from the controller 118. In some implementations, the exemplary system obtains $V_{IDEAL}$ from the controller 118 through the controller bus 108 at the ideal voltage DAC 440 or the compensation voltage generator 460 of the dynamic voltage compensator 130. In some implementations, the exemplary system obtains a digital $V_{IDEAL}$ from the controller 118. It is to be understood that the controller 118 can provide an analog $V_{IDEAL}$ directly to the dynamic voltage compensator 130 and any component thereof or associated therewith. The method 700 then continues to step 722. Alternatively, in some implementations, the method 700 continues to step 730 where the exemplary system receives obtains an analog $I_{IDEAL}$ at the dynamic voltage compensator 130.

At step 722, the exemplary system converts the obtained $V_{IDEAL}$ to an analog $V_{IDEAL}$. In some implementations, the exemplary system coverts IDEAL by the ideal voltage DAC 440. The method 700 then continues to step 730.

At step 730, the exemplary system detects an actual system voltage $V_{SYS}$ at the system node 132. In some implementations, the dynamic voltage compensator 130 detects $V_{SYS}$ at the compensation voltage generator 460 by system voltage sense line 138. The method 700 then continues to step 740. At step 740, the exemplary system obtains a predetermined gain K from the gain block 450. In some implementations, the exemplary system obtains K stored at the gain block 450. The method 700 then continues to step 742. At step 742, the exemplary system determines gain voltage $V_K$ based on the gain K and $I_K$. In some implementations, the gain block 450 determines $V_K$ by multiplying $I_K$ by K, where K equals or substantially equals $R_{SYS}$. The method 700 then continues to step 750.

At step 750, the exemplary system generates a voltage error based on $V_{IDEAL}$, $V_K$ and $V_{SYS}$. In some implementations, the exemplary system generates the voltage error at least in part by receiving $V_K$ and $V_{IDEAL}$ at respective positive terminals of the compensation voltage generator 460, and receiving $V_{SYS}$ at a negative terminal of the compensation voltage generator 460, where the compensation voltage generator 460 is an operational amplifier. The method 700 then continues to step 752. At step 752, the exemplary system generates a compensation voltage $V_{COMP}$ based on the voltage error. In some implementations, the exemplary system generates $V_{COMP}$ at least in part by generating, at the compensation voltage generator 460, a difference between $V_{SYS}$ and a sum of $V_{IDEAL}$ and $V_K$, and outputting the resulting voltage magnitude at an output of the compensation voltage generator 460. The method 700 then continues to step 760. At step 760, the exemplary system applies $V_{COMP}$ to the system node 132. In some implementations, the compensation voltage generator 460 outputs $V_{COMP}$ to the second converter 126. In some implementations, the method 700 ends at step 760. Alternatively, in some implementations, the method 700 continues to repeat one or more steps of one or more of the methods 600 and 700 to continuously apply $V_{COMP}$ to the system node 132.

The herein described subject matter sometimes illustrates different components contained within, or connected with, different other components. It is to be understood that such depicted architectures are illustrative, and that in fact many other architectures can be implemented which achieve the same functionality. In a conceptual sense, any arrangement of components to achieve the same functionality is effectively "associated" such that the desired functionality is achieved. Hence, any two components herein combined to achieve a particular functionality can be seen as "associated with" each other such that the desired functionality is achieved, irrespective of architectures or intermedial components. Likewise, any two components so associated can also be viewed as being "operably connected," or "operably coupled," to each other to achieve the desired functionality, and any two components capable of being so associated can also be viewed as being "operably couplable," to each other to achieve the desired functionality. Specific examples of operably couplable include but are not limited to physically mateable and/or physically interacting components and/or wirelessly interactable and/or wirelessly interacting components and/or logically interacting and/or logically interactable components With respect to the use of plural and/or singular terms herein, those having skill in the art can translate from the plural to the singular and/or from the singular to the plural as is appropriate to the context and/or application. The various singular/plural permutations may be expressly set forth herein for sake of clarity.

It will be understood by those within the art that, in general, terms used herein, and especially in the appended claims (e.g., bodies of the appended claims) are generally intended as "open" terms (e.g., the term "including" should be interpreted as "including but not limited to," the term "having" should be interpreted as "having at least," the term "includes" should be interpreted as "includes but is not limited to," etc.).

Although the figures and description may illustrate a specific order of method steps, the order of such steps may differ from what is depicted and described, unless specified differently above. Also, two or more steps may be performed concurrently or with partial concurrence, unless specified differently above. Such variation may depend, for example, on the software and hardware systems chosen and on designer choice. All such variations are within the scope of the disclosure. Likewise, software implementations of the described methods could be accomplished with standard programming techniques with rule-based logic and other logic to accomplish the various connection steps, processing steps, comparison steps, and decision steps.

It will be further understood by those within the art that if a specific number of an introduced claim recitation is intended, such an intent will be explicitly recited in the claim, and in the absence of such recitation, no such intent is present. For example, as an aid to understanding, the following appended claims may contain usage of the introductory phrases "at least one" and "one or more" to introduce claim recitations. However, the use of such phrases should not be construed to imply that the introduction of a claim recitation by the indefinite articles "a" or "an" limits any particular claim containing such introduced claim recitation to inventions containing only one such recitation, even when the same claim includes the introductory phrases "one or more" or "at least one" and indefinite articles such as "a" or "an" (e.g., "a" and/or "an" should typically be interpreted to mean "at least one" or "one or more"); the same holds true for the use of definite articles used to introduce claim recitations. In addition, even if a specific number of an introduced claim recitation is explicitly recited, those skilled in the art will recognize that such recitation should typically be interpreted to mean at least the recited number (e.g., the bare recitation of "two recitations," without other modifiers, typically means at least two recitations, or two or more recitations).

Furthermore, in those instances where a convention analogous to "at least one of A, B, and C, etc." is used, in general such a construction is intended in the sense one having skill in the art would understand the convention (e.g., "a system having at least one of A, B, and C" would include but not be limited to systems that have A alone, B alone, C alone, A and B together, A and C together, B and C together, and/or A, B, and C together, etc.). In those instances where a convention analogous to "at least one of A, B, or C, etc." is used, in general, such a construction is intended in the sense one having skill in the art would understand the convention (e.g., "a system having at least one of A, B, or C" would include but not be limited to systems that have A alone, B alone, C alone, A and B together, A and C together, B and C together, and/or A, B, and C together, etc.). It will be further understood by those within the art that virtually any disjunctive word and/or phrase presenting two or more alternative terms, whether in the description, claims, or drawings, should be understood to contemplate the possibilities of including one of the terms, either of the terms, or both terms. For example, the phrase "A or B" will be understood to include the possibilities of "A" or "B" or "A and B."

Further, unless otherwise noted, the use of the words "approximate," "about," "around," "substantially," etc., mean plus or minus ten percent.

The foregoing description of illustrative embodiments has been presented for purposes of illustration and of description. It is not intended to be exhaustive or limiting with respect to the precise form disclosed, and modifications and variations are possible in light of the above teachings or may be acquired from practice of the disclosed embodiments. It is intended that the scope of the invention be defined by the claims appended hereto and their equivalents.

What is claimed is:

1. A method for dynamically compensating a system voltage, comprising:

determining an actual load current based on a sense voltage across a sense resistor and a resistance of the sense resistor, the sense resistor being operatively coupled to a system node;

generating a gain current based on the actual load current and a predetermined load current;

determining a gain voltage based on a system gain and the gain current; and generating a compensation voltage based on a predetermined system voltage at the system node, an actual system voltage at the system node, and the gain voltage.

2. The method of claim 1, further comprising:

obtaining the system gain from a gain block device, wherein the system gain is a predetermined value stored by the gain block device.

3. The method of claim 1, wherein the system gain is a predetermined equivalent resistance at the system node.

4. The method of claim 1, further comprising:

generating a current error based on the actual load current and a predetermined load current, wherein the generating the gain current further comprises generating the gain current based on the current error.

5. The method of claim 1, further comprising:

generating a voltage error based on the ideal system voltage, the actual system voltage, and the gain voltage, wherein the generating the compensation voltage further comprises generating the compensation voltage based on the voltage error.

6. The method of claim 1, further comprising:

detecting the actual system voltage at the system node.

7. The method of claim 1, further comprising:

obtaining the predetermined load current from a controller device; and obtaining the predetermined system voltage from the controller device.

8. The method of claim 1, further comprising:

detecting a first sense input voltage at the sense resistor;

detecting a second sense input voltage at the sense resistor; and determining the sense voltage based on the first sense input voltage and the second sense input voltage.

9. The method of claim 1, further comprising:

applying the compensation voltage to the system node.

10. A method for calibrating a dynamic voltage compensation device, comprising:

applying a predetermined voltage to a system node operatively coupled to the system load, a sense resistor, and an internal system node;

obtaining a test current based on a sense voltage across the sense resistor and a resistance of the sense resistor;

obtaining a system resistance based on the predetermined voltage, the test current, and an internal system voltage at the internal system node; and setting a system gain based on the system resistance at a gain block device.

11. The method of claim 10, further comprising:

detecting a first sense input voltage at the sense resistor;

detecting a second sense input voltage at the sense resistor; and determining the sense voltage based on the first sense input voltage and the second sense input voltage.

12. The method of claim 10, further comprising:

isolating the system load from the internal system node.

13. The method of claim 10, further comprising:

transmitting the internal system voltage to a controller device; and transmitting the battery voltage to the controller device.

14. The method of claim 10, further comprising:

obtaining a battery resistance based on the test current and a battery voltage at a battery operatively coupled to the internal system node and the system node.

15. The method of claim 10, wherein the setting the system gain further comprises setting the system gain at a gain block device.

16. A dynamic voltage compensator device comprising:

a first input conditioning device operably coupled to a sense resistor, and operable to determine an actual load current based on a sense voltage across the sense resistor and a resistance of the sense resistor;

a gain block device operatively coupled to the first signal conditioning device and operable to determine a gain voltage based on a system gain and a gain current; and a third input conditioning device operatively coupled to the gain block device and a system node operatively coupled to the sense resistor, and operable to generate a compensation voltage based on the predetermined system voltage at the system node, an actual system voltage at the system node, and the gain voltage.

17. The dynamic voltage compensator device of claim 16, further comprising:

a second input conditioning device operably coupled to the first input conditioning device and the gain block device, and operable to generate the gain current based on the actual load current and the predetermined load current.

18. The dynamic voltage compensator device of claim 17, further comprising:

a first digital-to-analog converter device (DAC) operably coupled to the second input conditioning device and a controller device, and operable to obtain a digital predetermined load current from the controller device, and operable to convert the digital predetermined load current to an analog predetermined load current, wherein the predetermined load current comprises the analog predetermined load current.

19. The dynamic voltage compensator device of claim 16, further comprising:

a second digital-to-analog converter device (DAC) operatively coupled to the third input conditioning device and a controller device, and operable to convert a digital predetermined system voltage to an analog predetermined system voltage, wherein the predetermined system voltage comprises the analog predetermined system voltage.

20. The dynamic voltage compensator device of claim 19, wherein the third input conditioning device is further operatively coupled to a power converter, and is further operable to apply the compensation voltage to the system node.

* * * * *